US007996937B2

(12) United States Patent
Walter et al.

(10) Patent No.: US 7,996,937 B2
(45) Date of Patent: Aug. 16, 2011

(54) MATTRESS AND SHEET COMBINATION PROVIDING WRINKLE FREE SURFACE WITH RAISED PERIMETERS

(75) Inventors: Beau Walter, Milwaukee, WI (US); Anthony Patrick, Wauwatosa, WI (US)

(73) Assignee: Direct Supply, Inc., Milwaukee, WI (US)

( * ) Notice: Subject to any disclaimer, the term of this patent is extended or adjusted under 35 U.S.C. 154(b) by 0 days.

(21) Appl. No.: 12/642,251

(22) Filed: Dec. 18, 2009

(65) Prior Publication Data

US 2010/0154127 A1 Jun. 24, 2010

Related U.S. Application Data

(60) Provisional application No. 61/138,789, filed on Dec. 18, 2008.

(51) Int. Cl.
*A47G 9/02* (2006.01)

(52) U.S. Cl. ..... 5/485; 5/424; 5/425; 5/486; 5/497; 5/732

(58) Field of Classification Search ..... 5/485, 486, 5/497, 499, 731, 732, 424, 425, 946
See application file for complete search history.

(56) References Cited

U.S. PATENT DOCUMENTS

| | | | | |
|---|---|---|---|---|
| 2,644,173 | A * | 7/1953 | Wallace | 5/425 |
| 4,607,402 | A * | 8/1986 | Pollard | 5/425 |
| 4,754,509 | A * | 7/1988 | Pollard | 5/425 |
| 4,872,228 | A * | 10/1989 | Bishop | 5/425 |
| 4,873,734 | A * | 10/1989 | Pollard | 5/425 |
| 6,848,130 | B1 | 2/2005 | Wilson | |
| 7,246,388 | B2 | 7/2007 | DiLiberto, Jr. | |
| 2008/0256706 | A1 * | 10/2008 | Larsen | 5/425 |

* cited by examiner

*Primary Examiner* — Michael Trettel
(74) *Attorney, Agent, or Firm* — Boyle Fredrickson, S.C.

(57) ABSTRACT

The formation of wrinkles in bed sheets used on mattresses of the type having elevated side bolsters and the tendency of the sheets to come off when the mattress is articulated are reduced through the use of a fitted sheet having conforming pockets receiving the side bolsters. Stabilization of the upper sheet surface by the pockets is augmented in some embodiments through use of a stitch line placed along a seam on the inside of the pockets and/or by un-pocketed spans of the upper surface of the sheet connecting directly to an elastically retained skirt.

12 Claims, 3 Drawing Sheets

MATTRESS AND SHEET COMBINATION PROVIDING WRINKLE FREE SURFACE WITH RAISED PERIMETERS

CROSS-REFERENCE RELATED APPLICATIONS

This application claims the benefit of U.S. provisional application 61/138,789 filed Dec. 18, 2008 and hereby incorporated by reference.

BACKGROUND OF THE INVENTION

The present invention relates to mattresses used in patient care settings for pressure management and wound care, and in particular to an improved mattress/sheet combination.

The importance of mattress construction in preventing or treating pressure ulcers for patients who are mostly or completely bedridden or who are recovering from medical procedures is well recognized.

Often it is desired to provide for raised perimeter sections (bolsters) on the mattress to improve both safety and comfort by guiding the patient away from mattress edges. A standard flat or fitted/bottom sheet or deep-pocketed sheet may be used with such mattresses by laying it over the raised perimeter portions and tucking it in loosely around the mattress to prevent undue compression of the raised perimeter portions or a "spanning" of the sheet between the raised perimeter portions.

SUMMARY OF THE INVENTION

The present inventors have determined that standard sheeting when used with raised perimeter mattresses can create sheet wrinkles that produce uncomfortable pressure points for the patient. The present invention addresses this problem by means of a fitted sheet having corresponding pockets for receiving the raised perimeter portions. In one embodiment, the raised peripheral portions extend only part way along the length of the mattress leaving a center section without raised portions. The sheet across this center section and at mattress ends serves to stabilize the sheet of the pockets further helping to eliminate wrinkles that might be expected caused by the pocket's interference with drawing of the sheet tightly across the top of the bed. A seam may be positioned along the inside edge of the pockets, stiffening this edge further against pulling inward to the center of the bed, permitting wrinkles. The ability to produce a fitted sheet for this mattress type further greatly improves retention of the sheet on the mattress when the resident is repositioned, moved into and out of the bed or the bed is articulated.

Specifically, the present invention provides a fitted sheet for a mattress of a type having a substantially planar upper surface adapted to support a patient's body as flanked by left and right side bolsters rising from the upper surface, the bolsters extending along at least a portion of the length of the mattress. The fitted sheet includes a skirt having a lower elastic edge, the skirt sized to extend around the periphery of the mattress with the lower edge position positioned proximate to a lower surface of the mattress to elastically grip the same. A top portion of the sheet is sized to cover and lie substantially flat against the upper surface of the mattress while joining with an upper edge of the skirt at a foot and head of the top portion corresponding to a foot and head of the mattress when the fitted sheet is installed on the mattress. Bolster pockets join on outer edges with the skirt and on inner edges with the top portion, the bolster pockets including textile end elements attached, by stitching, to bolster pockets to define pocket corners and ends of the bolsters so that the bolster pockets substantially conform to the bolsters when the fitted sheet is installed on the mattress.

It is thus a feature of at least one embodiment of the invention to provide tailored pockets that may grip the bolsters to reduce wrinkling of the sheet.

Each bolster of the mattress may have a reduced height portion dividing the bolster into upper and lower full height portions and the top portion may join with an upper edge of the skirt at a left and right of the top portion after the top portion passes through the reduced height portion of the left and right side bolsters when the fitted sheet is installed on the mattress. The bolster pockets for the upper and lower full height portions may include additional textile end elements attached by stitching to the bolster pockets to define pocket corners at opposed ends of the upper and lower full height portions so that the bolster pockets substantially conform to the upper and lower full height portions of the bolsters when the fitted sheet is installed on the mattress.

It is thus a feature of at least one embodiment of the invention to provide multiple pockets of shorter length which provide improved stabilization along the length of the pocket and direct attachment of the top portion to the skirt providing conventional stabilization.

At least the top portion may be constructed of a breathable textile passing air through pores between textile fibers, for example a woven fabric such as a blend of cotton and polyester.

It is thus a feature of at least one embodiment of the invention to provide the advantages of the present invention in a material that may directly contact the patient.

The fitted sheet elements of the top sheet, bolster pockets, and skirt are constructed of a textile having a weight less than 8 ounces per square yard.

It is thus a feature of at least one embodiment of the invention to provide stabilization for relatively lightweight fabrics that cannot rely on inherent fabric stiffness to resist wrinkles.

The textile end elements may have trapezoidal areas attached to other elements of the fitted sheet by stitching along at least two edges of the trapezoidal area.

It is thus a feature of at least one embodiment of the invention to provide bolster pockets that are closely tailored to the bolsters for improved stabilization of the sheet.

When the sheet is fitted to the mattress, each bolster pocket may include: an upper horizontal part extending along at least a portion of the length of the sheet, an inwardly facing sloped part extending along the portion of the length of the sheet and attached at an upper edge to the upper horizontal part; an outwardly facing vertical part extending along the portion of the length of the sheet and attached at an upper edge to the upper horizontal part; and opposed head and foot panels attached to at least one of the upper planar part, inwardly facing sloped part, and outwardly facing vertical part by stitching; and the inwardly facing sloped part may attach to the top portion of the fitted sheet by stitching.

It is thus a feature of at least one embodiment of the invention to provide a reinforcing seam along an inner edge of the bolster to resist wrinkling.

The stitching may join at least three layers of textile in areas where the stitching is exposed to the patient.

It is thus a feature of at least one embodiment of the invention to provide a build up of textile thickness under the stitching such as reduces the perceived roughness of the stitching to the patient.

The stitching may be a contrasting color from the textile of the sheet.

It is thus a feature of at least one embodiment of the invention to provide a clear visual indication of the fitted nature of the sheet when the sheet is stored between washings.

The top sheet may have an orientation providing a greatest stretch of the textile across the width of the mattress.

It is thus a feature of at least one embodiment of the invention to orient the fabric to further reduce wrinkling and remain on the mattress during resident repositioning, bed entry or exit, and bed articulation.

These particular objects and advantages may apply to only some embodiments falling within the claims, and thus do not define the scope of the invention.

DETAILED DESCRIPTION OF THE INVENTION

Figure 3:
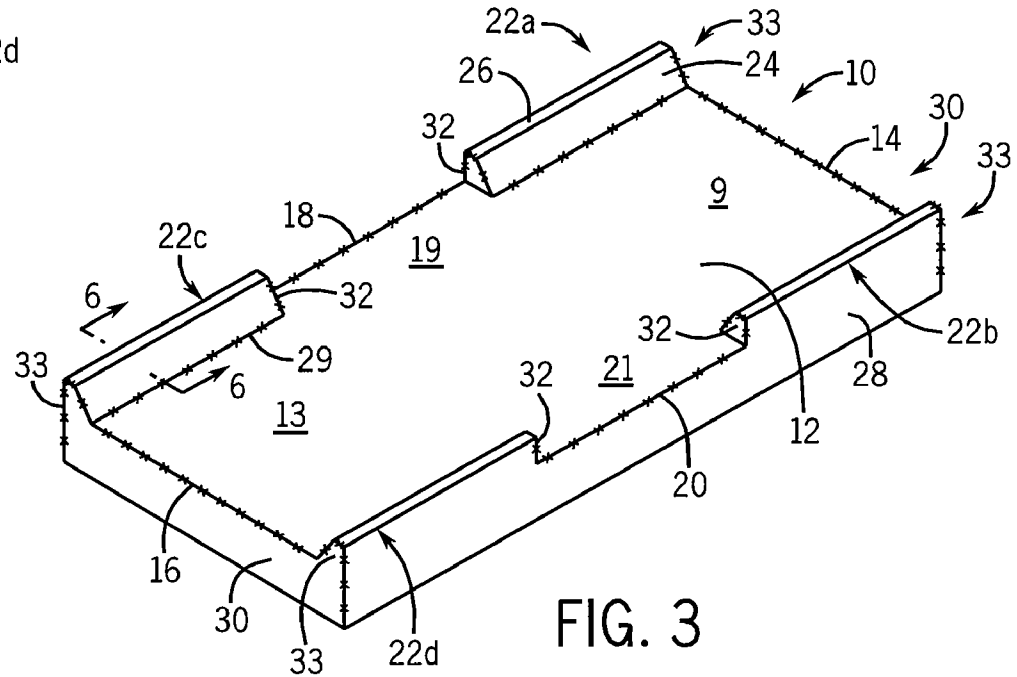
FIG. 3 is a perspective view of the sheet of FIGS. 1 and 2 showing stitched seams with the small x's.
Figure 2:
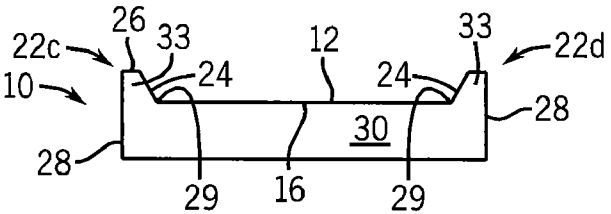
FIG. 2 is an end view of the sheet of FIG. 1.
Figure 1:
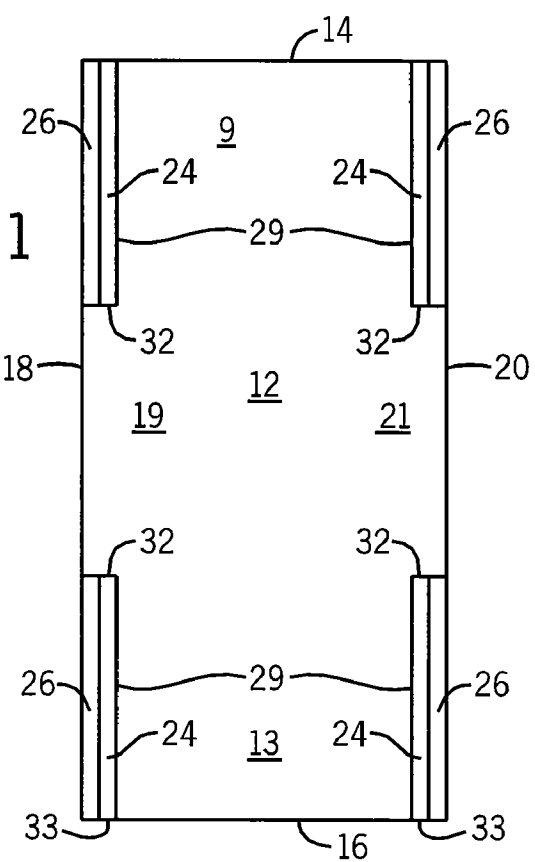
FIG. 1 is a top view of a sheet of the present invention fit to a corresponding mattress.

Referring now to FIGS. 1, 2 and 3, the present invention provides a fitted sheet 10 fitting to a mattress having substantially identical upper dimensions. Generally, when the sheet 10 is fit to the mattress, the sheet 10 presents a horizontal, cross-shaped, planar upper surface 12 having upper and lower arms 9 and 13 terminating at edges 14 and 16 of the upper surface of the mattress at the head and foot of the mattress respectively, and right and left arms 19 and 21 terminating at edges 18 and 20 of the upper surface of the mattress on the right and left side of the mattress respectively. The upper and lower arms 9 and 13 have a width slightly less than the width of the mattress, in one embodiment about 6 inches less than the width of the mattress, and the left and right arms 19 and 21 have a length of about twenty-six inches in one embodiment conforming to a particular commercially available mattress.

A skirt 40 extends around the periphery of the mattress covering the height of the mattress and is formed of side panels 28 at the left and right sides of the mattress, and end panels 30 at the head and foot ends of the mattress. Edges 20 and 18 of left and right arms 19 and 21 are attached directly to upper edges of side panels 28 by stitching.

At the corners of the plane defined by the upper surface 12, fitting between the pairs of arms 9 and 19, 9 and 21, 13 and 21, and 13 and 19 of the upper surface 12 to complete a rectangular boundary of the upper surface of the mattress, are upwardly extending bolster pockets 22*a-d* receiving corresponding raised peripheral portions of the underlying mattress. In one embodiment, the bolster pockets extend upward by about three inches.

The downwardly open bolster pockets 22 each include an inward sloping surface 24 extending parallel to a length of the sheet 10 and facing the patient, and an upper plateau 26 joined at one edge to an upper edge the inward sloping surface 24 and being generally parallel to the upper surface 12 while elevated therefrom. An outer vertical surface of each pocket 22 is provided by the side panel 28 connecting to a corresponding outer edge of the plateau 26. In one embodiment, the side panel 28, upper plateau 26, and inward sloping surface 24 are a single continuous panel of textile without stitched seams. In one embodiment, the joining of the inward sloping surface 24 to the edges of the arms 13 and 9 is by means of stitched seams 29 that stiffen these edges to prevent wrinkling.

End panels 30 at the head and foot of the sheet extend vertically in trapezoidal tabs 33 to provide end portions of the bolster pockets 22 at the head and foot respectively of the mattress. Finally, panels 32 provide trapezoidal textile elements filling the space between the upper surface 12, the side panels 28, the plateaus 26, and the inward sloping surface 24, at the inner opposed ends of the bolster pockets 22 flanking the arms 19 or 21. The trapezoidal tabs 33 and the panels 32 attached to the side panels 28, plateaus 26, and inward sloping surfaces 24, to form corners, being a joining of three fabric elements along pairwise edges that conceptually intersect at a single corner point as moderated by the realities of flexible fabric.

Figure 4:
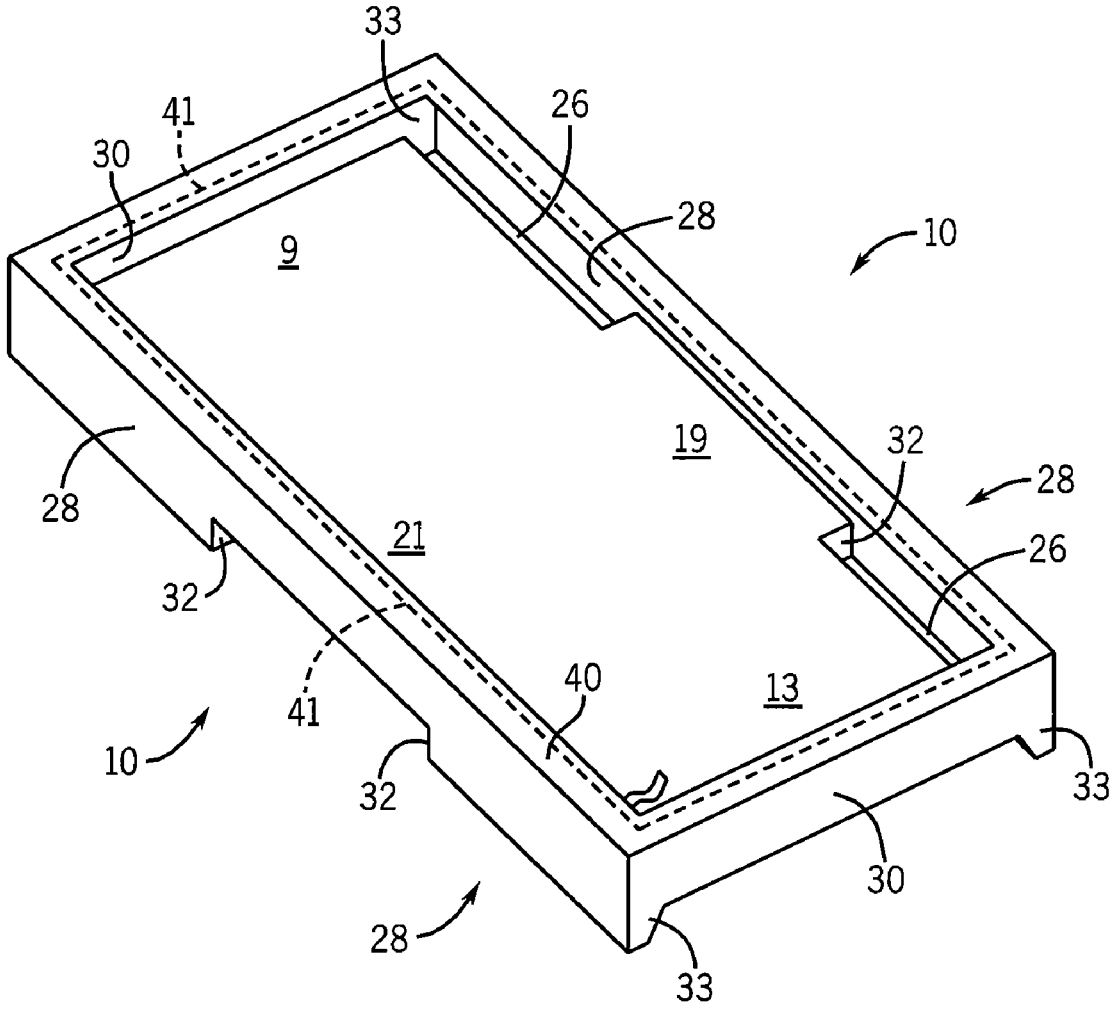
FIG. 4 is a bottom view of the sheet of the present invention as it wraps around the mattress.

Referring momentarily to FIG. 4, the end panels 30 and side panels 28 that form the skirt 40 have a lower edge that may be drawn under the mattress by an elastic cord 41 sewn to the edge of the skirt (for example as captured within a folded back seam). This skirt 40 provides a peripheral tensioning of the sheet 10 in the manner of a conventional fitted sheet.

The cross shape of the upper surface 12 and its tension, applied through the arms 19 and 21, and 9 and 13, may stabilize the sheet 10 and eliminate wrinkles of the type that could be formed with a single planar sheet fitted to this mattress type. The arms 19 and 21 in tension resist further movement of the upper surface 12 drawn by the tension of the skirt 40 that might lift the upper surface 12 of the sheet 10 into a spanning configuration between the bolsters, while the arms 9 and 13 in tension draw wrinkles out from the intersection between inward sloping surfaces 24 and the upper surface 12. The seam 29 running along the inside of the bolster pockets 22 and anchored in tension at the ends of the bolster pockets 22 also provides resistance to wrinkling by better retaining the edges of the arms 9 and 13 outward against the bolsters.

Figure 5:
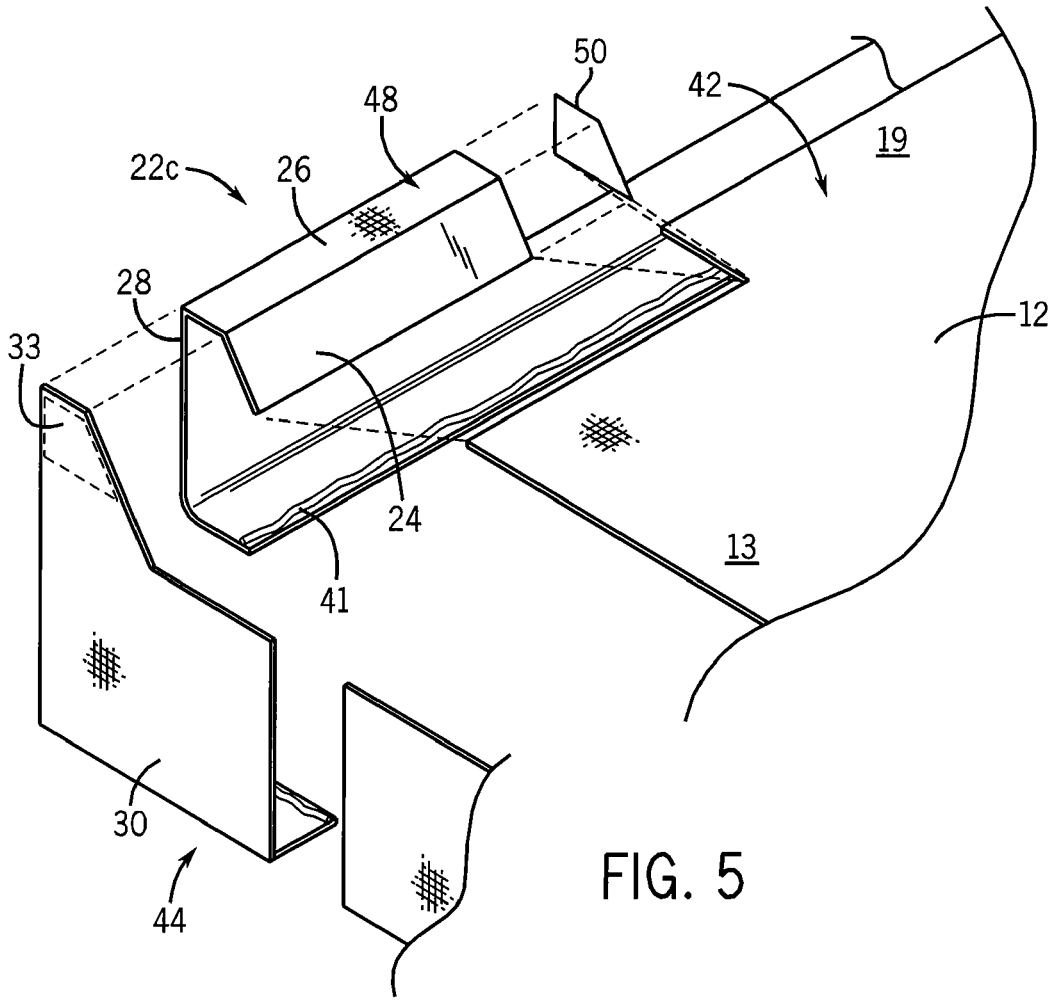
FIG. 5 is a an exploded diagram of the components of the sheet for one corner of the sheet.

Referring momentarily to FIG. 5, construction of the sheet 10 may employ four constituent continuous textile elements: top element 42 (duplicated once to provide the upper surface 12), end element 44 (duplicated twice to provide the end panels 30), side element 48 (duplicated twice to provide the left and right side panels 28 and the upper plateaus 26 and inner sloped surfaces 24 of the pockets 22), and cap element 50 duplicated four times to provide panels 32). These elements are joined by stitching at their interface with the other elements.

Figure 6:
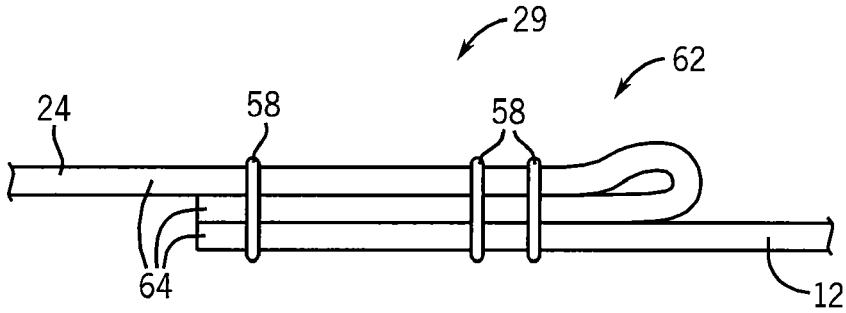
FIG. 6 is a cross-sectional view through a stitched patient-contacting seam.

Referring to FIG. 6, the stitching 58 of each of the seams 29 may be done so that exposed ends of the stitching 58 on a side 62 exposed to the patient will pass through at least three layers of textile 64 such as provides a perception of greater softness in the stitching to the patient. Decorative stitching with thread of contrasting color provides an indication of the special qualities of the sheet in its folded condition to distinguish it from regular sheets. Generally, the material of the sheet may be 50% cotton 50% polyester having a weight of approximately 5.07 ounces per square yard and less than 8 ounces per square yard and a thickness of approximately 0.019 inches and is preferably a woven or nonwoven polyester or cotton polyester that is breathable. The material of the upper surface 12 may be oriented to provide the greatest stretch across the width of the mattress (i.e. in a direction parallel to that extending between arms 19 and 21).

Referring again to FIG. 3, it will be understood that certain features of the present invention, including the pockets 22 and stiffening seams 29, may also be employed with the mattress having a continuous left and right side bolster by the simple expedient of merging pockets 22*a* and 22*c* and pockets 22*b* and 22*d* with the elimination of arms 19 and 21. Further it will be understood that arms 19 and 21 may surmount, without the need for pockets, a reduced height section of such continuous bolsters between pockets 22*a* and 22*c* or 22*b* and 22*d*. As used herein "reduced height portion" of a bolster should be considered to include a portion having a lower height than other portions of the bolster or even zero height (that is even with the upper surface 12).

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A fitted sheet for a mattress of a type having a substantially planar upper surface adapted to support a patient's body as flanked by left and right side bolsters rising from the upper surface, the bolsters extending along at least a portion of a length of the mattress, the fitted sheet comprising:

a skirt having a lower elastic edge, the skirt sized to extend around a periphery of the mattress with the lower edge position positioned proximate to a lower surface of the mattress to elastically grip the same;

a top portion sized to cover and lie substantially flat against the upper surface of the mattress while joining with an upper edge of the skirt at a foot and head of the top portion, corresponding to a foot and head of the mattress when the fitted sheet is installed on the mattress;

bolster pockets including a textile end elements attached by stitching to the bolster pockets to define pocket corners at ends of the bolsters so that the bolster pockets substantially conform to the bolsters when the fitted sheet is installed on the mattress, the bolster pockets joining on outer edges with the skirt and on inner edges with the top portion, and the textile end elements joining at lower edges with the skirt; and the skirt, top portion and bolster pockets defining an unbroken volume open at a lower edge of the skirt to receive the mattress and bolster upwards therein.

2. A fitted sheet for a mattress of a type having a substantially planar upper surface adapted to support a patient's body as flanked by left and right side bolsters rising from the upper surface, the bolsters extending along at least a portion of a length of the mattress, wherein each bolster of the mattress has a reduced height portion dividing the bolster into upper and lower full height portions and wherein the top portion joins with an upper edge of the skirt at a left and right of the top portion after passing through the reduced height portion of the left and right side bolsters when the fitted sheet is installed on the mattress, the fitted sheet comprising:

a skirt having a lower elastic edge, the skirt sized to extend around a periphery of the mattress with the lower edge position positioned proximate to a lower surface of the mattress to elastically grip the same;

a top portion sized to cover and lie substantially flat against the upper surface of the mattress while joining with an upper edge of the skirt at a foot and head of the top portion, corresponding to a foot and head of the mattress when the fitted sheet is installed on the mattress; and bolster pockets including textile end elements attached by stitching to the bolster pockets to define pocket corners at ends of the bolsters so that the bolster pockets substantially conform to the bolsters when the fitted sheet is installed on the mattress, the bolster pockets joining on outer edges with the skirt and on inner edges with the top portion, wherein the bolster pockets including additional textile end elements attached by stitching to bolster pockets to define pocket corners at inner opposed ends of the upper and lower full height portions so that the bolster pockets substantially conform to the upper and lower full height portions of the bolsters when the fitted sheet is installed on the mattress.

3. The fitted sheet of claim 1 wherein at least the top portion is constructed of a breathable textile passing air through pores between textile fibers.

4. The fitted sheet of claim 3 wherein the textile is a woven fabric.

5. The fitted sheet of claim 4 wherein the textile is a blend of cotton and polyester.

6. The fitted sheet of claim 1 wherein the fitted sheet elements of the top sheet, bolster pockets, and skirt are constructed of a textile having a weight less than 8 ounces per square yard.

7. The fitted sheet of claim 1 wherein, when the sheet is fitted to the mattress, each bolster pocket includes an upper horizontal part extending along at least a portion of the length of the sheet, an inwardly facing sloped part extending along the portion of the length of the sheet and attached at an upper edge to the upper horizontal part, an outwardly facing vertical part extending along the portion of the length of the sheet and attached at an upper edge to the upper horizontal part, and opposed panels attached to at least one of the upper planar part, inwardly facing sloped part, and outwardly facing vertical part by stitching; and wherein the inwardly facing sloped part attaches to the top portion of the fitted sheet by stitching.

8. The fitted sheet of claim 1 wherein the stitching joins at least three layers of textile in areas where the stitching is exposed to the patient.

9. The fitted sheet of claim 1 wherein the stitching is a contrasting color from the textile of the sheet.

10. The fitted sheet of claim 1 wherein the top portion has an orientation providing a greatest stretch of the textile across a width of the mattress.

11. A fitted sheet for a mattress of a type having a substantially planar upper surface adapted to support a patient's body as flanked by left and right side bolsters rising from the upper surface, the bolsters extending along at least a portion of a length of the mattress, the fitted sheet comprising:

a skirt having a lower elastic edge, the skirt sized to extend around a periphery of the mattress with the lower edge position positioned proximate to a lower surface of the mattress to elastically grip the same;

a top portion sized to cover and lie substantially flat against the upper surface of the mattress while joining with an upper edge of the skirt at a foot and head of the top portion, corresponding to a foot and head of the mattress when the fitted sheet is installed on the mattress; and bolster pockets including textile end elements attached by stitching to the bolster pockets to define pocket corners at ends of the bolsters so that the bolster pockets substantially conform to the bolsters when the fitted sheet is installed on the mattress, the bolster pockets joining on outer edges with the skirt and on inner edges with the top portion, wherein the textile end elements have trapezoidal areas attached to other elements of the fitted sheet by stitching along at least two edges of the trapezoidal area.

12. A fitted sheet for a mattress of a type having a substantially planar upper surface adapted to support a patient's body as flanked by left and right side bolsters rising from the upper surface, the bolsters extending along at least a portion of a length of the mattress, the fitted sheet comprising:

a skirt having a lower elastic edge, the skirt sized to extend around a periphery of the mattress with the lower edge position positioned proximate to a lower surface of the mattress to elastically grip the same;

a top portion sized to cover and lie substantially flat against the upper surface of the mattress while joining with an upper edge of the skirt at a foot and head of the top portion, corresponding to a foot and head of the mattress when the fitted sheet is installed on the mattress; and bolster pockets including a textile end elements attached by stitching to the bolster pockets to define pocket corners at ends of the bolsters so that the bolster pockets substantially conform to the bolsters when the fitted sheet is installed on the mattress, the bolster pockets joining on outer edges with the skirt and on inner edges with the top portion; and the mattress comprising:

an upper resilient surface adapted to support a patient's body as flanked by left and right side bolsters rising from the upper surface and extending along at least a portion of the length of the mattress, each bolster having a reduced height portion dividing the bolster into upper and lower full height portions; and a mattress cover covering the upper resilient surface with a non-breathable moisture-impermeable sheet-like covering.

* * * * *